US008822892B2

(12) United States Patent
Huang

(10) Patent No.: US 8,822,892 B2
(45) Date of Patent: Sep. 2, 2014

(54) COMBINED METAL PTC RAPID ELECTRIC HEATER

(75) Inventor: Ji Huang, Shanghai (CN)

(73) Assignee: Shanghai Huazu Industry Co., Ltd., Shanghai (CN)

( * ) Notice: Subject to any disclaimer, the term of this patent is extended or adjusted under 35 U.S.C. 154(b) by 322 days.

(21) Appl. No.: 13/277,670

(22) Filed: Oct. 20, 2011

(65) Prior Publication Data

US 2013/0098898 A1 Apr. 25, 2013

(51) Int. Cl.

| | |
|---|---|
| ***H05B 3/06*** | (2006.01) |
| ***H05B 3/50*** | (2006.01) |
| ***H05B 3/10*** | (2006.01) |
| ***H05B 3/48*** | (2006.01) |

(52) U.S. Cl.

CPC ..... *H05B 3/50* (2013.01); *H05B 2203/02* (2013.01); *H05B 3/48* (2013.01)

USPC ..... 219/552; 530/540

(58) Field of Classification Search

USPC ..... 219/552, 530, 540

See application file for complete search history.

(56) References Cited

U.S. PATENT DOCUMENTS

| | | | | |
|---|---|---|---|---|
| 4,963,717 | A * | 10/1990 | Woelfle | 219/270 |
| 5,367,607 | A * | 11/1994 | Hufnagl et al. | 392/465 |
| 2008/0037969 | A1 * | 2/2008 | Von Der Luhe et al. | 392/480 |

* cited by examiner

*Primary Examiner* — Dana Ross
*Assistant Examiner* — Lindsey C Teaters

(57) ABSTRACT

A combined metal PTC rapid electric heater for use in the electric heating field composes at least one electric heating device. The electric heating device composes a metal PTC tube which is covered by an electric heating tube body. The electric heating tube body composes two straight tubes and one C-shape tube. At one end of a straight tube is a wiring terminal and at another end of that is connected to a C-shape tube. Two straight tubes are connected together by using a C-shape tube. Thus, in this design only one combined metal PTC rapid electric heater is needed for area requiring two common electric heaters. Furthermore, this design can simplify wiring layout during installation since two wiring terminals are located in the same side.

7 Claims, 2 Drawing Sheets

COMBINED METAL PTC RAPID ELECTRIC HEATER

TECHNICAL FIELD

This invention relates to a field of electrical heating. In particularly, it relates to electric heaters.

BACKGROUND ART

Electric heaters are widely used in areas of small electrical heating appliance, temperature control systems, car heaters, airplane heaters, train heaters, ship heaters and so on.

As quality of life is improved in recent years, temperature control systems are widely used. In regarding temperature control systems, electric heaters not only provide supplemental heating functions, also provide the pre-heating function for anti-frozen liquid to help starting systems in case of cold temperature, e.g., below −5 C. The temperature control systems are usually used in a closed space to frequently decrease or increase surrounding temperature in a long period of time.

The characteristics of electric heaters require graceful distribution of heat energy, efficient energy emission, small in size and easy for installation. Regarding these characteristics, the current electric heaters still need some improvements.

DISCLOSURE OF THE INVENTION

The purpose of the present invention is to provide the combined metal PTC rapid electric heater to solve the above mentioned technical concerns. The present invention resolves these technical concerns as follows:

The combined metal PTC rapid electric heater comprises at least one electric heating device. This electric heating device comprises a metal PTC tube. The outside of this metal PTC tube is covered by an electric heating tube body. The outside of this electric heating tube body has radiating fins in place. The characteristics of this electric heating tube body include two straight tubes and one C-shape tube.

One end of this straight tube has a wiring terminal and another end of this straight tube is connected to one end of a C-shape tube. The other straight tube has also a wiring terminal at one end and is connected to another end of a C-shape tube at the other end. The heat-conducting electric-insulating powder is filled between a metal PTC tube and an electric heating tube body.

Using the C-shape tube, a combined metal PTC rapid electric heater connects two straight tubes together to accomplish the effect of two existing common electric heaters. Thus, instead of installing two common electric heaters, it only needs to install one combined metal PTC rapid electric heater in this design. Furthermore, two wiring terminals are located in the same side of a combined type metal PTC rapid electric heater. It can ease wiring work during actual implementation. There is no radiating fin outside a C-shape tube to simplify production process and ensure easy installation.

A combined metal PTC rapid electric heater comprises at least two electric heating devices which are laid in parallel along the thickness direction of said C-shape tubes. There are at least two radiating fins placed on the electric heating tube body. At least two electric heating tube bodies of electric heating devices are simultaneously and separately inserted through each of these radiating fins. This design can firmly place at least two electric heating tubes together through radiating fins. It helps facilitating the production and installation processes. Especially, it makes tubes fastened firmly and neatly in place. The quantity of said electric heating devices is 1 to 12. These (1 to 12) electric heating devices are laid sequentially in parallel, front to back, in the thickness direction of said C-shape tubes.

In order to ease the production and installation processes and to firmly and neatly fasten electric heating devices, there are at least two (2) said electric heating devices laid in parallel in the width direction of said C-shape tubes.

DETAILED DESCRIPTIONS OF THE PREFERRED EMBODIMENTS

In order to better understanding techniques, characteristics and objectives of the present invention, the following descriptions and the accompanying above figures further illustrate the invention.

Figure 1:
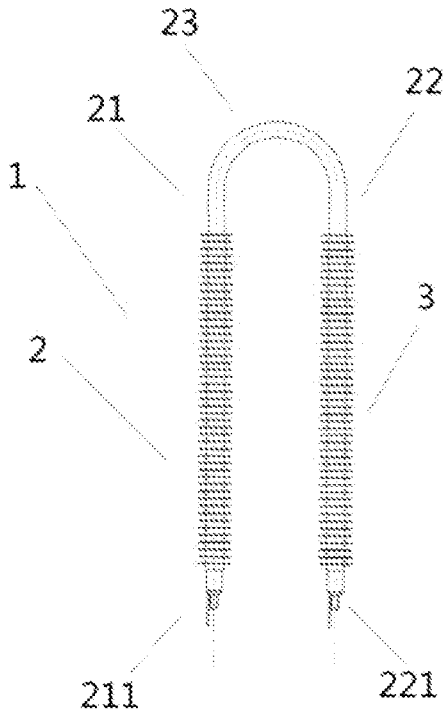
FIG. 1 is a main view of a combined metal PTC rapid electric heater in Embodiment 1.

In reference of FIG. 1, the combined metal PTC rapid electric heater composes at least one electric heating device 1. An electric heating device composes a metal PTC tube which is covered by an electric heating tube body 2. There is the heat-conducting electric-insulating powder filled between a metal PTC tube and an electric heating tube body 2. Multiple heat radiating fins 3 are placed outside of an electric heating tube body. An electric heating tube body 2 of an electric heating device 1 composes two straight tubes 21, 22 and one C-shape tube 23. One end of a straight tube 21 has a wiring terminal, 211, another end of a straight tube 21 is connected to a C-shape tube 23. One end of the other straight tube 22 also has a wiring terminal 221, another end of the straight tube 22 is connected to the other end of a C-shape tube 23.

Comparing with common electric heating tubes, the metal PTC tube has important technical advantages: when in use, sometime portion of common electric heating tubes may generate high temperature to form partial open-circuit arc that can burn out or melt down portion of electric heater's protection sleeve to cause a fire. One feature of a metal PTC tube is that when portion of tube's temperature is raised, its electrical resistance is also increased to avoid burn out a tube.

Using a C-shape tube 23, a combined metal PTC rapid electric heater connects two straight tubes 21 and 22 together to accomplish the effect two existing common electric heaters. Thus, with this design, it needs only one combined metal PTC rapid electric heater for a place originally requires installing two common electric heaters. Furthermore, this design can ease wiring work during the installation since two wiring terminals 211 and 221 are located in the same side of a combined metal PTC rapid electric heater. With no radiating fins placed outside C-shape tubes, it can simplify the manufacture process and ensure firm installation.

Embodiment 1

Figure 2:
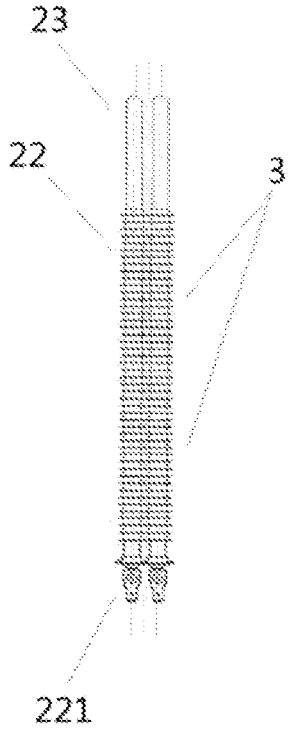
FIG. 2 is a side view of a combined metal PTC rapid electric heater in Embodiment 1.

In reference of FIGS. 1 and 2, a combined metal PTC rapid electric heater composes at least two electric heating devices 1 that are laid in parallel, front to back, in the thickness direction of C-shape tubes 23. There are at least two heat radiating fins 3 placed on an electric heating tube body 2. The electric heating tube bodies 2 of those (at least two) electric heating devices 1 are separately and simultaneously inserted through each of those (at least two) radiating fins 3. Using radiating fins 3, this design can fasten firmly together at least two electric heating devices 1, and help simplifying production and installation processes. In the practical implementation, the number of electric heating devices 1 is between 2 to 12. These electric heating devices 1 are laid sequentially in parallel front to back in the thickness direction of C-shape tubes 23 to meet the heating requirements.

Embodiment 2

Figure 3:
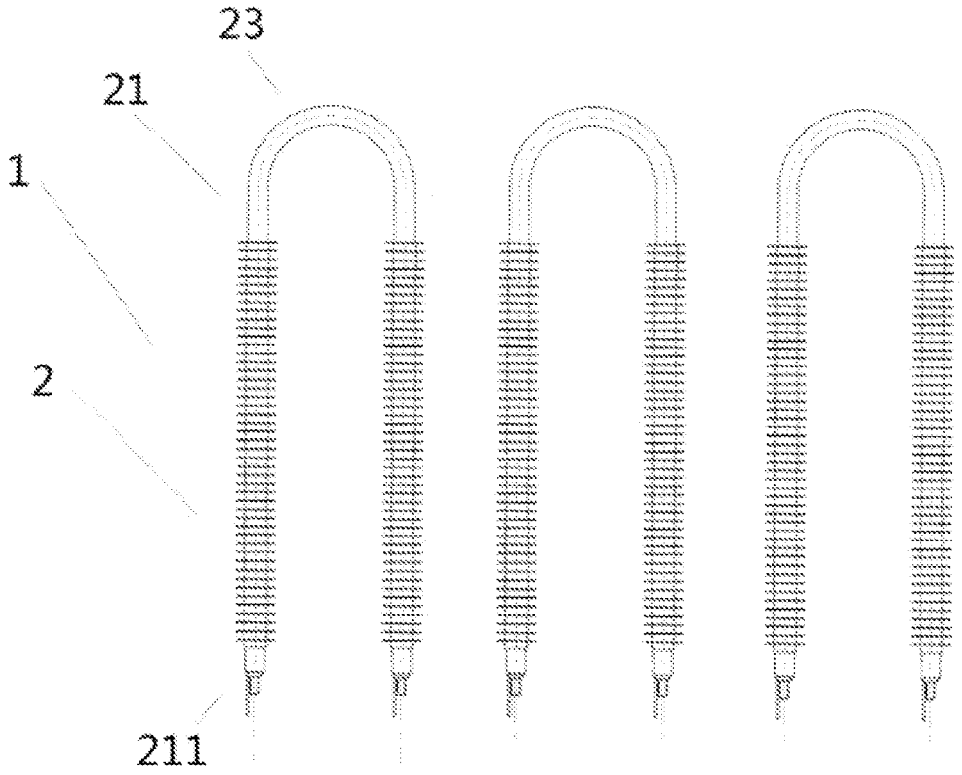
FIG. 3 is a main view of a combined metal PTC rapid electric heater in Embodiment 2.

In reference of FIG. 3, at least two electric heating devices 1 are laid in parallel sequentially in the width direction of C-shape heating tubes 23. In the practical implementations, the number of electric heating devices 1 may be between 2 to 12. Those electric heating devices 1 are laid in parallel widthwise of C-shape tubes 23 to meet the heating requirements.

The structure of Embodiment 1 can combine the structure of Embodiment 2 in practical implementations. A combined metal PTC rapid electric heater can have structures of both Embodiments 1 and 2 together.

The above descriptions, embodiments and figures are only intended to illustrate the basic and main principles and characteristics of the present invention as an example. It is to be noted that various changes and modifications are apparent to those skilled in the art are possible and are within the scope of this invention as defined by the appended claims.

What is claimed is:

1. A combined metal PTC rapid electric heater comprising:

at least one electric heating device having a metal PTC tube and a tubular shaped electric heating tube body; wherein the diameter of the metal PTC tube is smaller than the diameter of the electric heating tube body, wherein the metal PTC tube is disposed inside the electric heating tube body so that the two are concentric, wherein a plurality of heat radiating fins are attached to the outer surface of said electric heating tube body, wherein said combined metal PTC rapid electric heater is characterized in that said electric heating tube body has two straight tubes and one C-shape tube; and one of said straight tubes having a wiring terminal at one end and at the other end being connected to said C-shaped tube, and another of said straight tubes also having a wiring terminal at one end and at the other end being connected to the same said C-shape tube, and each end of said C-shape tube is connected to each of the two said straight tubes.

2. A combined metal PTC rapid electric heater as defined in claim 1, wherein space between the outer surface of said metal PTC tube and the inner surface of the said electric heating tube body is filled with heat-conducting electric-insulating powder.

3. A combined metal PTC rapid electric heater as defined in claim 2, wherein said C-shaped tube has no radiating fins installed.

4. A combined metal PTC rapid electric heater as defined in claim 3, wherein said combined metal PTC rapid electric heater has at least two of said electric heating devices which are laid sequentially in parallel, front to back, in the thickness direction of said C-shape tubes.

5. A combined metal PTC rapid electric heater as defined in claim 4, wherein said electric heating tube bodies of said electric heating devices that are laid in parallel, front to back, having at least two radiating fins, at least two of said electric heating tube bodies are separately and simultaneously inserted through each of said radiating fins.

6. A combined metal PTC rapid electric heater as defined in claim 5, wherein the number of said electric heating devices is 1 to 12 and said electric heating devices are laid sequentially in parallel, front to back in the thickness direction of said C-shape tubes.

7. A combined metal PTC rapid electric heater as defined in claim 1, wherein at least two of said electric heating devices are laid sequentially in parallel in the width direction of said C-shape tubes.

* * * * *